US006168096B1

(12) United States Patent
Potschin et al.

(10) Patent No.: US 6,168,096 B1
(45) Date of Patent: Jan. 2, 2001

(54) FUEL INJECTION DEVICE FOR INTERNAL COMBUSTION ENGINES

(75) Inventors: Roger Potschin, Brackenheim; Friedrich Boecking, Stuttgart, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/465,844

(22) Filed: Dec. 17, 1999

(30) Foreign Application Priority Data

Dec. 28, 1998 (DE) ..... 198 60 397

(51) Int. Cl.[7] ..... F23D 14/68

(52) U.S. Cl. ..... 239/533.3; 239/124; 239/533.4

(58) Field of Search ..... 239/533.3, 533.4, 239/533.5, 533.8, 533, 9, 533.2, 192.2, 96, 88

(56) References Cited

U.S. PATENT DOCUMENTS 4,946,106 * 8/1990 Turchi et al. ..... 239/533.3
5,429,154 * 7/1995 Kato ..... 239/533.8
5,651,503 * 7/1997 Ricco ..... 239/533.4
5,671,715 * 9/1997 Tsuzuki ..... 239/96
5,803,369 * 8/1998 Toyao et al. ..... 239/533.8
5,839,661 * 11/1998 Iwanaga ..... 239/88
5,860,597 * 1/1999 Tarr ..... 239/533.3
5,904,300 * 5/1999 Augustin ..... 239/533.8
6,027,047 * 2/2000 Augustin ..... 239/533.3
6,092,737 * 7/2000 Bosch et al. ..... 239/96

* cited by examiner

*Primary Examiner*—Andres Kashnikow
*Assistant Examiner*—Christopher S. Kim
(74) *Attorney, Agent, or Firm*—Ronald E. Greigg; Edwin E. Greigg

(57) ABSTRACT

A fuel injection device for internal combustion engines which under the control of a control unit supplies fuel injection valves with fuel from a high-pressure fuel source. The fuel injection valve has an injection valve member, whose opening and closing position is determined by a pressure acting upon the injection valve member set in a control chamber. To perform an injection, the pressure in the control chamber must be relieved, which is accomplished with a control valve that opens two different outflow cross sections of an outflow conduit of the control chamber in succession. It is thus possible to accomplish an adapted opening of a fuel injection valve member for a preinjection and a main injection.

20 Claims, 4 Drawing Sheets

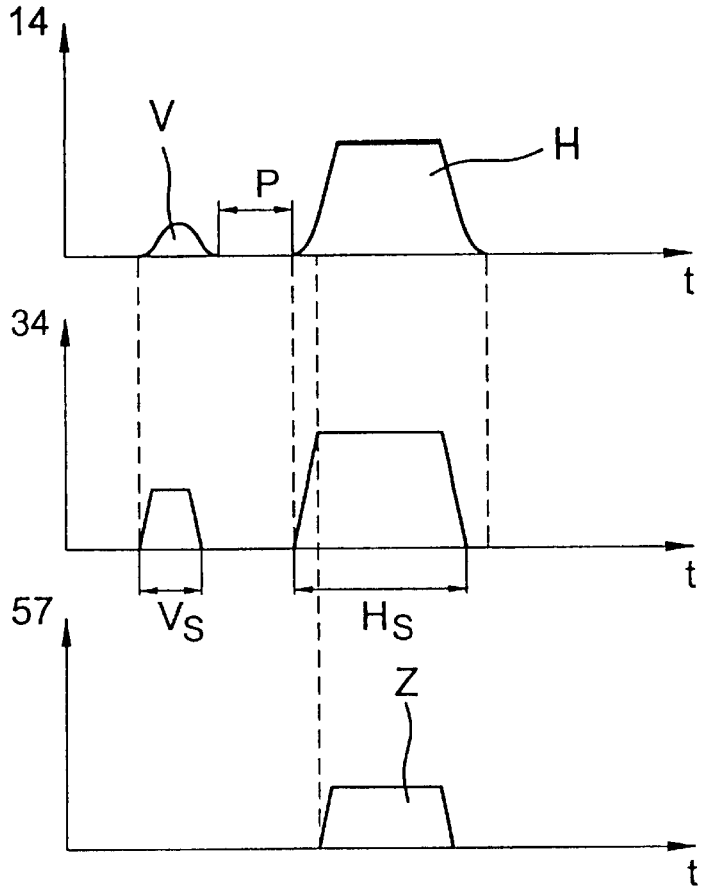
FIG. 3a
FIG. 3b
FIG. 3c
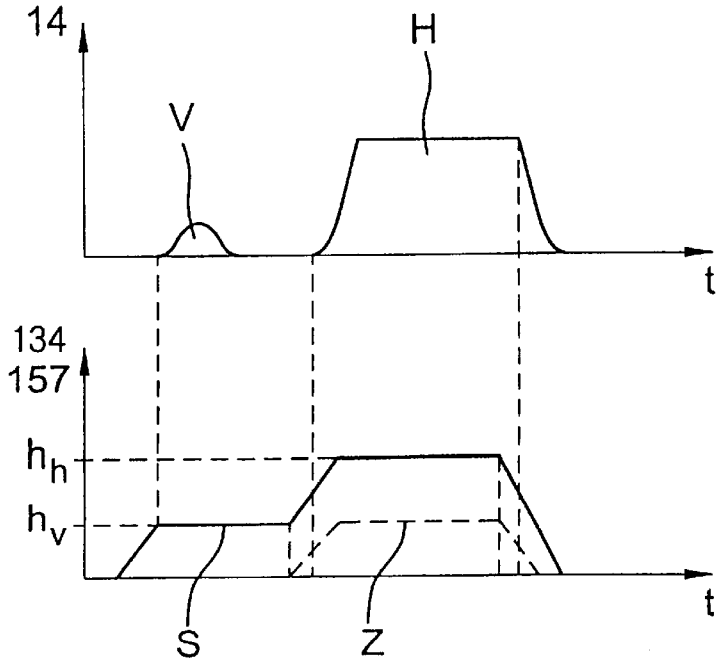
FIG. 5a
FIG. 5b

FUEL INJECTION DEVICE FOR INTERNAL COMBUSTION ENGINES

BACKGROUND OF THE INVENTION

The invention is based on a fuel injection device for internal combustion engines. In one such fuel injection device, known from German Patent Disclosure DE 196 24 001 A1, the valve chamber in a first version communicates with the control chamber without any reduction in cross section. Upon actuation by the piezoelectric actuator, the control valve makes the outflow cross section to the outflow conduit either fully open or the central valve closes the outflow cross section. In another version, the valve chamber communicates with the control chamber via a connecting conduit, and the connecting conduit is coaxial with the valve seat on the side of the outflow conduit. By actuation of the control valve member by the piezoelectric actuator, either the outflow cross section from the valve chamber to the outflow conduit is fully opened or closed, or to attain a preinjection, the control valve member is moved away from the valve seat toward the outflow conduit to the entrance of the connecting conduit and to the valve chamber; as a consequence of this motion, the control chamber is briefly opened to the outflow conduit via the valve chamber. For an ensuing main injection, the control valve member is moved into a middle position, in which both the cross section toward the outflow conduit and the cross section of the connecting conduit into the valve chamber are fully opened. This embodiment has the disadvantage that to relieve the pressure in the control chamber, only a single, geometrically defined outflow cross section to the outflow conduit exists. The preinjection quantity in the second version described is such that the speed of adjustment of the control valve member by the piezoelectric actuator and the geometrically defined travel of the control valve member are predetermined variables for the degree of relief of the pressure in the control chamber. In particular, the maximum relief cross section is the same for both the relief for the preinjection and for the relief for the main injection, which is disadvantageous in view of any fine adaptation of the opening speed of the injection valve in various operating conditions.

OBJECT AND SUMMARY OF THE INVENTION

The fuel injection device according to the invention has an advantage that two different outflow cross sections can be established in succession, by making two different connection cross sections to the control chamber as a function of the position of the control valve member. It is thus possible to graduate the outflow cross section as a function of the stroke. Particularly for a slight relief of the control pressure in the control chamber, a first, smaller outflow cross section can come into effect, with which the preinjection stroke of the injection valve member can be set with greater precision. For the main injection, a large outflow cross section is subsequently available, which allows a fast motion of the injection valve member.

Advantageously, a cross section that is additional to the first connection cross section is provided as the second connection cross section. This makes it possible to attain a large effective change in cross section. The first connection cross section is located in a space-saving way in the intermediate valve member, where sufficiently large flow cross section is furnished on the outer circumference. The second connection cross section can be defined by the flow cross section at the interstices between the longitudinal ribs, which is determined by the stroke of the intermediate valve member, which uncovers a certain flow cross section between the sealing seat shoulder and the sealing face.

In a further feature crosswise connections that are always open are furnished between the connecting conduit of the valve member and the valve chamber, so that this connecting conduit is ready as an always-open first connection cross section, to which a further, second connection cross section is added when the intermediate valve member is opened.

It is also advantageous to close the connecting conduit in the intermediate valve member when the control valve member contacts the intermediate valve member; thus the cross section of the connecting conduit is furnished not in the intermediate valve member, but along the outer circumference of the intermediate valve member.

The invention will be better understood and further objects and advantages thereof will become more apparent from the ensuing detailed description of preferred embodiments taken in conjunction with the drawing.

BRIEF DESCRIPTION OF THE DRAWINGS

FIGS. 3*a* through 3*c* show the stroke courses of the injection valve member, control valve member and intermediate valve member of the exemplary embodiment of FIG. 2;

FIGS. 5*a* through 5*b* show the stroke courses of the injection valve member, control valve member and intermediate valve member of the exemplary embodiment of FIG. 4.

DESCRIPTION OF THE PREFERRED EMBODIMENTS

A fuel injection device with which a wide variation of the fuel injection with regard to the injection quantity and the instant of injection is possible at high injection pressures and at little expense is achieved by a so-called common rail system. This makes a different kind of high-pressure fuel source available than exists with the usual high-pressure fuel injection pumps. However, the invention is also applicable in principle to conventional fuel injection pumps. Nevertheless, its use in a common rail injection system is especially advantageous.

Figure 1:
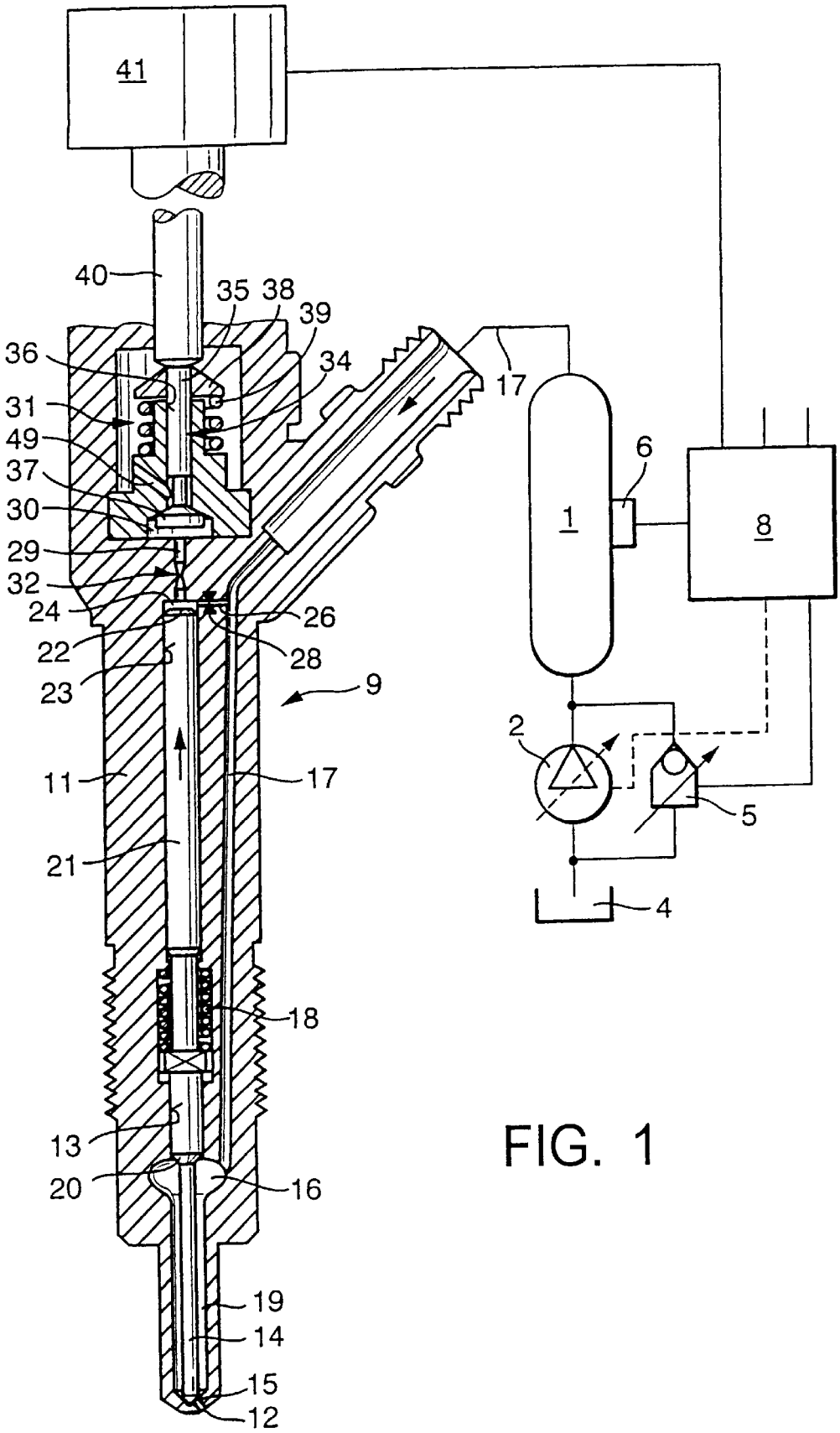
FIG. 1 is a schematic illustration of a fuel injection device with fuel supply from a high-pressure fuel reservoir, and with a fuel injection valve of known design.

In the common rail injection system shown in FIG. 1, a high-pressure fuel reservoir 1 is provided as the high-pressure fuel source, and it is supplied with fuel by a high-pressure fuel feed pump 2 by a fuel supply container 4. The pressure in the high-pressure fuel reservoir 1 is detected by a pressure sensor 6 and delivered in the form of a signal to an electric control unit 8, which via a pressure control valve 5 controls the pressure in the high-pressure fuel reservoir. Alternatively, the supply quantity of the high-pressure fuel pump can be varied in this way. The control unit also controls the opening and closing of high-pressure fuel injection valves 9, which are supplied for injection with fuel from the high-pressure fuel reservoir.

In a known version, the fuel injection valve 9 has a valve housing 11, which on one end, that is, the end intended for mounting in the engine, has injection ports 12, whose outlet from the interior of the fuel injection valve is controlled by an injection valve member 14. This valve member is embodied in the example being described as an elongated valve needle, which on one end has a conical sealing face 15 that cooperates with an inner valve seat on the valve housing, and from there the injection ports 12 lead away. The injection ports can also begin at a bore that adjoins the valve seat. The valve needle is guided in a longitudinal bore 13 by its upper end, remote from the sealing face 15, and is urged in the closing direction on the end remote from the sealing face 15 and emerging from the longitudinal bore 13 by a compression spring 18. Between where it is guided in the longitudinal bore 13 and the valve seat, the valve needle 14 is surrounded by an annular chamber 19, which discharges into a pressure chamber 16 that in turn communicates constantly, via a pressure line 17, with the high-pressure fuel reservoir 1. In the region of this pressure chamber, the valve needle 14 has a pressure shoulder 20, by which it is acted upon by the pressure in the pressure chamber 16, counter to the force of the spring 18, in the direction of lifting of the sealing face 15 from the valve seat.

The valve needle is also actuated by a tappet 21, whose face end 22, remote from the valve needle 14, defines a control chamber 24 in a tappet guide bore 23. This control chamber communicates constantly with the pressure line 17, or the high-pressure fuel reservoir 1, via an inflow conduit 26 in which an inflow throttle 28 is provided. The inflow conduit discharges from the side into the control chamber 24 and cannot be closed. Coaxially with the tappet 21, a connecting conduit 29 leads away from the control chamber 24 and discharges into a valve chamber 30 of a control valve 31. In the connecting conduit, which at the same time is an outflow conduit, a diameter limitation is provided, preferably in the form of an outflow throttle 32. The detailed structure of the control valve 31 is shown more specifically in the exemplary embodiments of FIGS. 2 and 3. A common feature of these exemplary embodiments is that the control valve 31 includes a control valve member 34, which comprises a valve tappet 35, the valve tappet 35 is guided in a tappet bore 36, and a valve head 37, is located on an end of the control valve member 34 that protrudes into the valve chamber 30. On the end of the valve tappet 35 opposite the valve head, a spring plate 38 is provided, a compression spring 39 is supported on the spring plate 38 that seeks to urge the control valve member into the closing position. In the opposite direction, the control valve member 34 is acted upon by a piston 40, which is part of a piezoelectric actuator 41 and upon excitation of the piezoelectric element the control valve member is positioned in different opening positions depending on the degree of excitation of the piezoelectric element. The piston can either be joined directly to the piezoelectric element of the piezoelectric actuator, or it can be moved by this element, by means of a hydraulic or mechanical intensification.

For a more-detailed illustration of the embodiment of the control valve 31 according to the invention, the control valve will be described in further detail in conjunction with FIG. 2. Once again, the end of the tappet 21 is shown, which actuates the valve needle 14. The tappet 21, with a face end 22 acting as a movable wall, encloses the control chamber 24 in the tappet guide bore 23. The upward adjustment of the tappet 21, in the opening direction of the injection valve member 14, is limited by a stop 42 that leaves an outer annular chamber 43 open, into which the inflow conduit 26 discharges. The connecting conduit 29 leads axially away in the region of the stop 42 and discharges into the valve chamber 30. This valve chamber has a circular- cylindrical circumferential wall 45, which changes over at a conical valve seat 46 into an annular chamber 48 surrounding the valve tappet 35. From this annular chamber, an outflow conduit 49 leads to a fuel return or to a relief chamber.

The valve head 37 disposed on the end of the valve tappet 35 has a conical valve head sealing face 51, remote from the entrance of the connecting conduit 29 into the valve chamber 30, and this sealing face cooperates with the valve seat 46 and thus controls the communication between the valve chamber 30 and the annular chamber 48 or the adjoining outflow conduit 49. The annular chamber 48 is formed by a recess on the circumference of the valve tappet 35, adjacent to the sealing face 51 of the valve head 37, and this recess communicates with the tappet bore 36 leading away from the valve chamber 30.

The side of the valve head toward the connecting conduit 29 has a flat face end 53, which upon actuation of the valve tappet 35 comes into contact with a face end 54 of an intermediate valve member 57, which forms an intermediate valve 56, and upon further actuation of the valve tappet 35, the intermediate valve member 57 is moved out of its closing position.

The intermediate valve member 57 has ribs 59 on its outer circumference, between which flow cross sections are formed and which are guided by their face ends in a guide bore 60. Toward the valve chamber 30, the guide bore 60 narrows via a sealing seat shoulder 62, to form a connecting bore 63 that discharges into the valve chamber 30 coaxially with the guide bore. The sealing seat shoulder 62 thus acts as the valve seat of the intermediate valve member.

The part of the intermediate valve member 57 that has the ribs 59 tapers, adjoining the ribs, via a conical sealing face 64 to form a cylindrical actuating portion 65, which protrudes through the connecting bore with a clearance from the connecting bore into the valve chamber 30. On the opposite side, the intermediate valve member 57 is loaded by a closing spring 68, which puts the intermediate valve member with its sealing face 64 into contact with the sealing seat shoulder 62. The closing spring 68 is supported at the transition between the guide bore 60 and the portion 29 leading onward of the outflow conduit, which discharges into the control chamber 24 coaxially with the guide bore 60.

Extending through the intermediate valve member 57 is an axial connecting conduit 69, which also connects the valve chamber 30 with the control chamber 24 via the portion 29 of the outflow conduit, when the intermediate valve member 57 is in its closing position. The connecting conduit can be embodied as a stepped bore, of which one stepped bore portion 70, located toward the control chamber 24 and having a smaller diameter, determines a first connection cross section. On the side of the valve chamber 30 in the region of the actuating portion 65, at least one recess 71 leads away from the connecting conduit 69, extending crosswise to it, in such a way that upon contact of the flat face end 53 of the valve head 37 with the face end 54 of the intermediate valve member 57, the communication between the control chamber 24 and the control chamber 30 is preserved, and the portion 70 of the connecting conduit 69 continues to determine the connection cross section.

Figure 2:
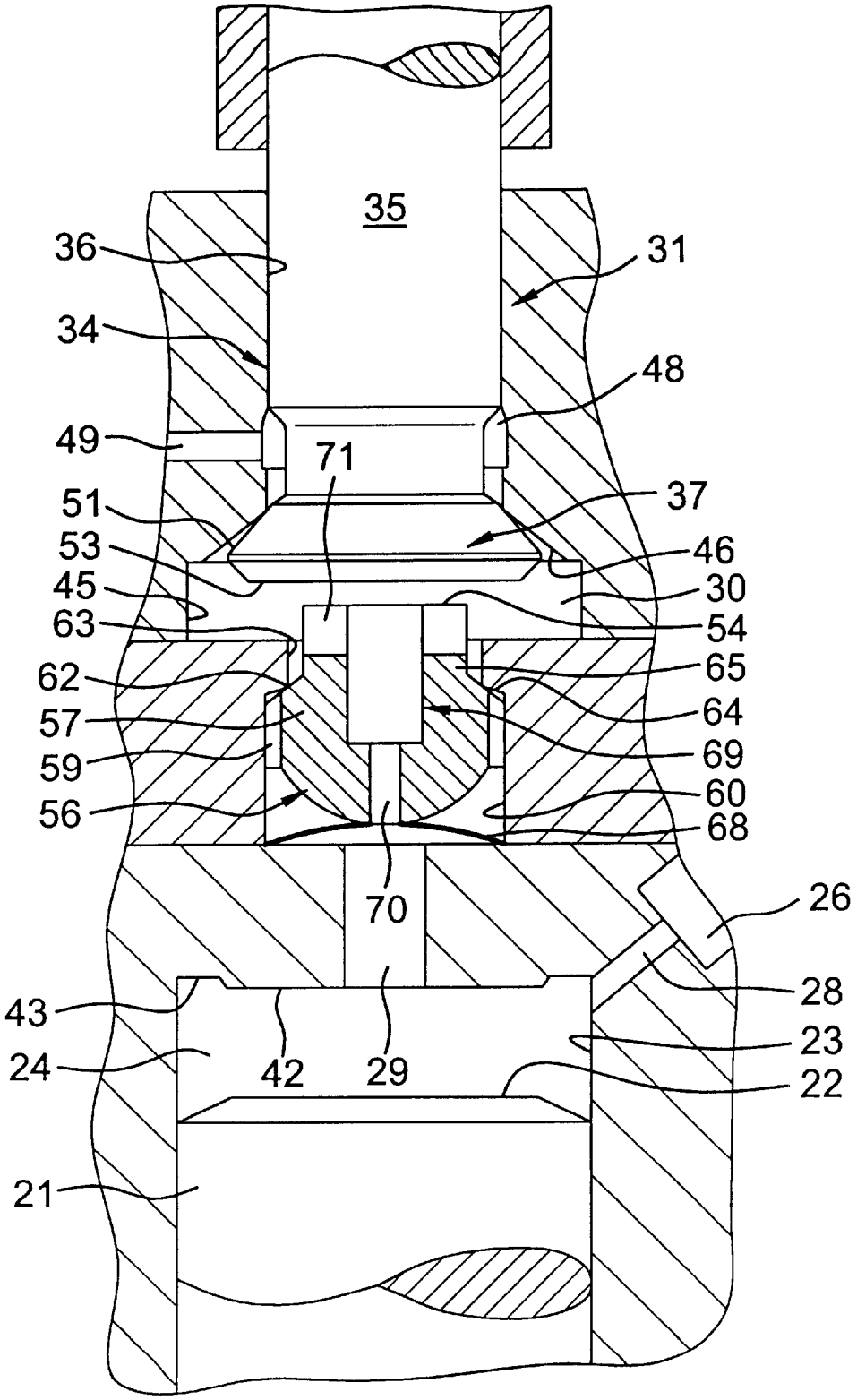
FIG. 2 shows a first exemplary embodiment of the invention, with a control valve member that actuates a first embodiment of an intermediate valve member.

The mode of operation of the embodiment of FIG. 2 is such that to trip a fuel injection with the aid of the control valve 31, the pressure in the control chamber 24 is lowered by opening the outflow conduit 29, 70, 69, 30, 48, 49. With decoupling by the throttle 28 in the inflow conduit 26, the pressure in the control chamber 24 drops in such a way that the valve member opens under the influence of the opening forces in the pressure chamber 16, counter to the force of the spring 18. The degree of opening of the injection valve member 14 can be varied by means of the magnitude of the control chamber, or the quantity of the pressure fluid or fuel flowing out there. If the control valve member 34 executes only a partial stroke, such that the face end 53 does not come into contact with the intermediate valve member 57, then this determines the maximum flow through the portion 70 of the connecting conduit 69. The relief rate and thus the stroke of the injection valve member 14 are correspondingly slight. Hence only a slight fuel injection quantity, for instance for introducing a preinjection quantity into the combustion chamber, is pumped. However, if a larger fuel quantity is meant to gain injection, then the control valve member 34 opens fully and comes into contact with the intermediate valve member 57 and lifts the valve member 57 from the sealing seat shoulder 62 via the actuating portion 65 and thus in addition to the first connection cross section makes a second connection cross section available, the latter being determined by the portion 70. The second connection cross section can be determined either by the flow cross section between the sealing seat shoulder 62 and the sealing face 64, or by the remaining flow area between the ribs 59. By means of the now-added second connection cross section, the relief of the control chamber 24 is faster and greater in extent, so that the injection valve member 14 can be opened to the intended extent, for instance with a stroke determined by the contact of its end face 22 with the stop 42.

The partial relief of the control chamber 24 for performing the preinjection has the advantage that upon closure of the control valve member 34, the pressure can build up again very rapidly, since the pressure has not been reduced as much as it would otherwise be reduced.

The functional sequence described can be understood better from FIGS. 3*a* through 3*c*. FIG. 3*a* shows the stroke of the injection valve member 14 over time. The stroke of the injection valve member for the preinjection V and the stroke of the injection valve member for performing the main injection H can be seen. These strokes are interrupted by an injection pause P. In FIG. 3*b*, the stroke of the control valve member 34 required for the purpose is shown, represented by a short stroke $V_s$ and a long stroke $H_s$. In FIG. 3*c*, finally, the stroke Z of the intermediate valve member over time is plotted, with the association with the stroke $H_s$ of the control valve member 34 and the stroke H for the main injection of the injection valve member 14.

Figure 4:
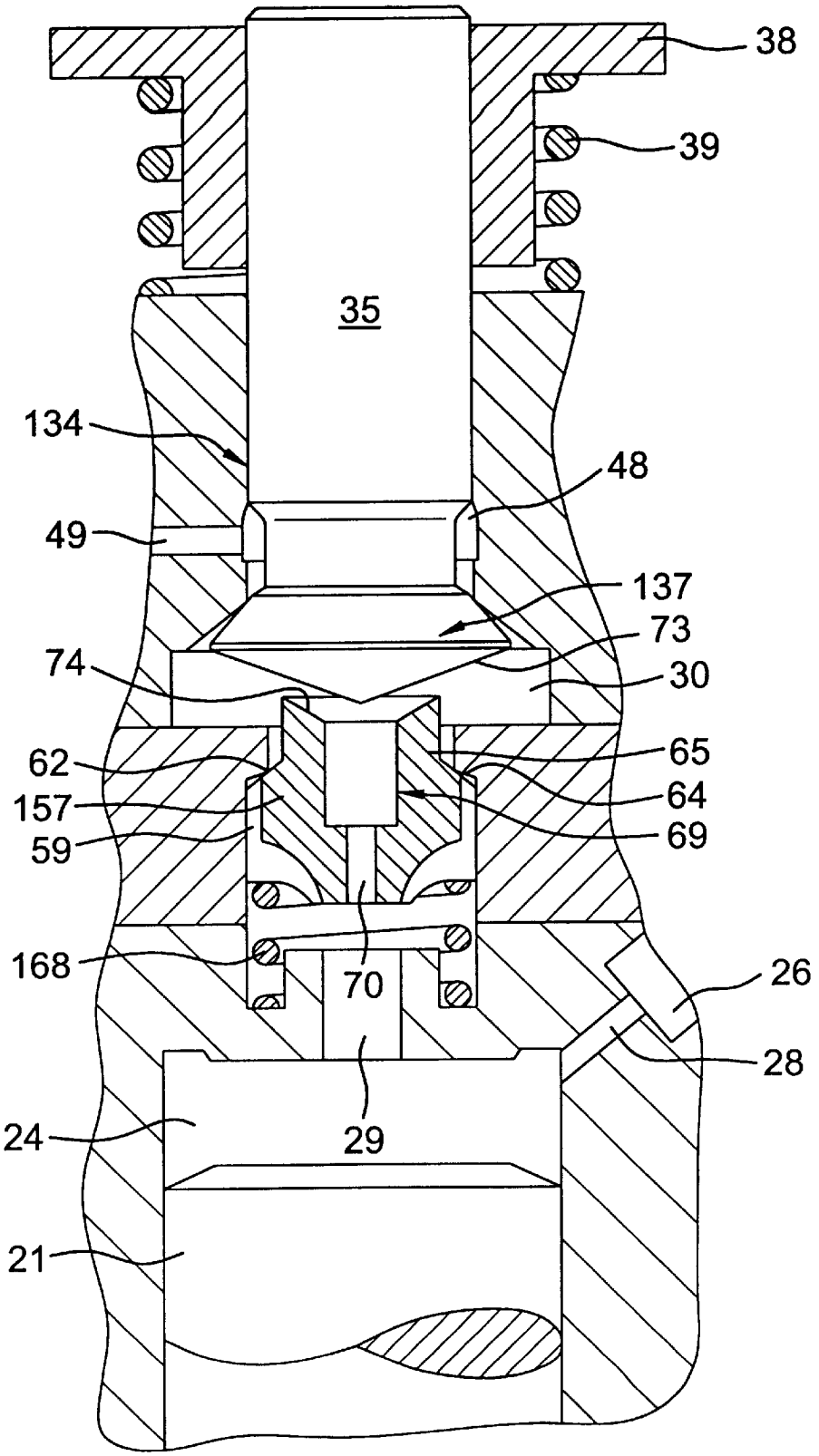
FIG. 4 shows a modification of the exemplary embodiment of FIG. 2, with an intermediate valve member whose connecting conduit can be closed by the control valve member.

In FIG. 4, a second exemplary embodiment of the invention is shown, in a modification of the version of FIG. 2. With an otherwise identical construction, the difference here is that the valve head 134 instead of the flat face end 53 now has a conical face end 73, embodied as a sealing face, which cooperates with a face end, embodied as a valve seat 74, of the intermediate valve member 157. The valve seat 74 surrounds the axial connecting conduit 69, provided in the intermediate valve member 57 of FIG. 2, in the region of its outlet at the actuating portion 65 into the valve chamber 30. Instead of a leaf spring 68 provided in the exemplary embodiment of FIG. 2, a spiral spring 168 is now provided, which loads the intermediate valve member 157 from the side of the control chamber 24 and keeps the intermediate valve 157 with its sealing face 64 in contact with the sealing seat shoulder 62, as long as the intermediate valve member 157 has not been displaced by the control valve member 134. In this version, the portion 70 of the connecting conduit 69 again forms the first connection cross section between the control chamber 24 and the valve seat 62, but the connection is closed whenever the control valve member 134 comes into contact with the intermediate valve member 157 by seating the on the conical valve head 137 on the conical valve seat 74. Now, however, by lifting of the intermediate valve member 157, the second connection cross section between the ribs 59, or between the sealing seat shoulder 62 and the sealing face 64, is opened. The second connection cross section is designed such that the second connection is correspondingly larger than the first connection cross section 70 of the portion of the connecting conduit 69, taking into account the fact that here the flow cross section of the second connection cross section takes the place of the flow cross section of the first connection cross section. This design can be more favorable in an individual instance, to make it possible to define the second connection cross section more exactly.

In FIG. 5*a*, analogously to FIG. 3*a*, the stroke of the injection valve member 14 is plotted over time, again with the stroke V for the preinjection and the stroke H for the main injection. From FIG. 5*b*, it can be seen that in the present case the further advantage of the feature of FIG. 4 is that the control valve member, to interrupt the fuel injection between the preinjection V and main injection H, does not have to be returned to its original closing position. As indicated by the curve course S, the control valve member 134 executes a strokes hV in the process comes into contact with the conical valve seat 74 of the intermediate valve member. Over the travel distance between the closing position of the control valve member 134 at its conical valve seat 46 and its contact with the conical valve seat 74, the relief of the control chamber 24 takes place, determined by the first connection cross section of the portion 70 of the connecting conduit 69, which leads to the preinjection. After that, with the closure of the connecting conduit 69, the pressure in the control chamber 24 can build up again and can close the injection valve member. For the main injection, the control valve member 134 is moved onward up to the stroke $h_h$, and in the process it opens the intermediate valve member as indicated by the stroke curve Z. With this opening of the intermediate valve, the relief of the control chamber 24 takes place at a higher relief rate, and accordingly the opening stroke of the injection valve member that is required for the main injection is made possible.

The foregoing relates to preferred exemplary embodiments of the invention, it being understood that other variants and embodiments thereof are possible within the spirit and scope of the invention, the latter being defined by the appended claims.

We claim:

1. A fuel injection device for internal combustion engines comprising:

a high-pressure fuel source (1); and a fuel injection valve (9) supplied with fuel from the high-pressure fuel source, said fuel injection valve comprising:

a housing;

at least one injection port (12);

an injection valve member (14) for controlling said at least one injection port (12);

an inflow conduit (26) connected with the high-pressure fuel source (1);

a movable wall (22) which communicates at least indirectly with the injection valve member (14), the movable wall (22) connected with the inflow conduit (26);

a control chamber (24) defined by the movable wall (22);

a valve control chamber (30);

a piezoelectric actuator (41);

a control valve (31) having a control valve member (34), the control valve member (34) further comprising a valve tappet (35) and a valve head (37), the control valve member (34) actuated by the piezoelectric actuator (41), the tappet (35) guided in the housing, the valve head (37) protruding into the valve control chamber (30), the valve head (37) provided with a valve head sealing face (51), the valve head sealing face (51) cooperating with a valve seat (46) to control an outflow of fuel, whereby when the control valve (31 ) is closed, the valve chamber (30) is exposed to a pressure of the high-pressure fuel source (1);

an outflow conduit (29) which leads from the control chamber (24) to the valve control chamber (30), the control valve (31) controlling the outflow from the control chamber (24) through the outflow conduit (29);

an intermediate valve (56) including an intermediate valve member (57) and a connecting conduit (70), the intermediate valve (56) disposed in a portion of the outflow conduit, the connecting conduit with a first connection cross section provided between the valve control chamber (30) and the control chamber (24), whereby the intermediate valve member (57) is moved by the valve head (37) of the control valve member (34) out of a closing position toward the control chamber (24) counter to a closing force and in this movement a second connection cross section between the valve chamber (30) and the control chamber (24) is opened up.

2. The fuel injection device according to claim 1, in which the second connection cross section is in addition to the first connection cross section.

3. The fuel injection device according to claim 1, in which the connecting conduit (69) leads through the intermediate valve member (57, 157) and is closed by the control valve member (34) when the intermediate valve member (57, 157) is lifted from its valve seat (62), and that the second connection cross section is larger than the first connection cross section (70).

4. The fuel injection device according to claim 2, in which the intermediate valve member (57, 157) is guided on an outer circumference in a guide bore (60), which originates at the control chamber (24) and narrows, via a sealing seat shoulder (62) acting as a valve seat, said sealing seat shoulder forms an adjoining connecting bore (63) that discharges into the valve chamber (30), and the intermediate valve member (57, 157) has a sealing face (64), at a transition from a guide portion guided in the guide bore (60) and an actuating valve portion (65) that protrudes with a clearance toward the wall of the connecting bore (63) into the valve chamber (30) and can be brought with the sealing face into contact with the sealing seat shoulder (62) by a force of a closing spring (68).

5. The fuel injection device according to claim 3, in which the intermediate valve member (57, 157) is guided on an outer circumference in a guide bore (60), which originates at the control chamber (24) and narrows, via a sealing seat shoulder (62) acting as a valve seat, said sealing seat shoulder forms an adjoining connecting bore (63) that discharges into the valve chamber (30), and the intermediate valve member (57, 157) has a sealing face (64), at a transition from a guide portion guided in the guide bore (60) and an actuating valve portion (65) that protrudes with a clearance toward the wall of the connecting bore (63) into the valve chamber (30) and can be brought with the sealing face into contact with the sealing seat shoulder (62) by a force of a closing spring (68).

6. The fuel injection device according to claim 4, in which the intermediate valve member (57, 157) has longitudinal ribs (59) for guidance, which slide along the wall of the guide bore (60).

7. The fuel injection device according to claim 5, in which the intermediate valve member (57, 157) has longitudinal ribs (59) for guidance, which slide along the wall of the guide bore (60).

8. The fuel injection device according to claim 6, in which the second connection cross section is formed between the longitudinal ribs (59) and the wall of the guide bore (60).

9. The fuel injection device according to claim 7, in which the second connection cross section is formed between the longitudinal ribs (59) and the wall of the guide bore (60).

10. The fuel injection device according to claim 6, in which the second connection cross section is adjusted between the sealing seat shoulder (62) and the sealing face (64) while the intermediate valve member (57, 157) is lifted.

11. The fuel injection device according to claim 7, in which the second connection cross section is adjusted between the sealing seat shoulder (62) and the sealing face (64) while the intermediate valve member (57, 157) is lifted.

12. The fuel injection device according to claim 6, in which the connecting conduit (69) leads axially through the intermediate valve member (57, 157) and has crosswise connections (71) on the end of the actuating portion (65) toward the valve chamber, which crosswise connections, when the valve head (37) is resting on its face end on the actuating portion (65), maintains the communication between the valve chamber (30) and the connecting conduit (69).

13. The fuel injection device according to claim 8, in which the connecting conduit (69) leads axially through the intermediate valve member (57, 157) and has crosswise connections (71) on the end of the actuating portion (65) toward the valve chamber, which crosswise connections, when the valve head (37) is resting on its face end on the actuating portion (65), maintains the communication between the valve chamber (30) and the connecting conduit (69).

14. The fuel injection device according to claim 10, in which the connecting conduit (69) leads axially through the intermediate valve member (57, 157) and has crosswise connections (71) on the end of the actuating portion (65) toward the valve chamber, which crosswise connections, when the valve head (37) is resting on its face end on the actuating portion (65), maintains the communication between the valve chamber (30) and the connecting conduit (69).

15. The fuel injection device according to claim 6, in which the connecting conduit (69) leads axially through the intermediate valve member (57, 157) and on the end of the actuating portion (65) toward the valve chamber ends in a valve seat (74), on which the valve head (37) comes to rest before the intermediate valve member (57, 157) is lifted from the valve seat (62) by the valve head (37), and the communication between the valve chamber (30) and the connecting conduit (69) is thus closed.

16. The fuel injection device according to claim 8, in which the connecting conduit (69) leads axially through the intermediate valve member (57, 157) and on the end of the actuating portion (65) toward the valve chamber ends in a valve seat (74), on which the valve head (37) comes to rest before the intermediate valve member (57, 157) is lifted from the valve seat (62) by the valve head (37), and the communication between the valve chamber (30) and the connecting conduit (69) is thus closed.

17. The fuel injection device according to claim 10, in which the connecting conduit (69) leads axially through the intermediate valve member (57, 157) and on the end of the actuating portion (65) toward the valve chamber ends in a valve seat (74), on which the valve head (37) comes to rest before the intermediate valve member (57, 157) is lifted from the valve seat (62) by the valve head (37), and the communication between the valve chamber (30) and the connecting conduit (69) is thus closed.

18. The fuel injection device according to claim 4, in which the closing spring is a leaf spring (68).

19. The fuel injection device according to claim 5, in which the closing spring is a leaf spring (68).

20. The fuel injection device according to claim 4, in which the closing spring is a spiral spring (168).

* * * * *